US005782562A

United States Patent [19]

Anspacher

[11] Patent Number: 5,782,562

[45] Date of Patent: Jul. 21, 1998

[54] HANDLE FOR RESEALABLE CONTAINER

[76] Inventor: Richard B. Anspacher, P.O. Box 8300-397, Dallas, Tex. 75205

[21] Appl. No.: 620,473

[22] Filed: Mar. 22, 1996

Related U.S. Application Data

[63] Continuation-in-part of Ser. No. 320,330, Oct. 11, 1994, abandoned.

[51] Int. Cl.[6] ..... B65D 33/06

[52] U.S. Cl. ..... 383/15; 383/16; 383/17; 383/63

[58] Field of Search ..... 383/14, 15, 16, 383/17, 20, 63, 65

[56] References Cited

U.S. PATENT DOCUMENTS

| | | | |
|---|---|---|---|
| D. 235,739 | 7/1975 | Christensen . | |
| D. 304,546 | 11/1989 | Cattach . | |
| 1,596,355 | 8/1926 | Hirsch . | |
| 3,282,493 | 11/1966 | Kamins et al. | 383/15 X |
| 3,402,749 | 9/1968 | Kinzler . | |
| 3,462,068 | 8/1969 | Suominen . | |
| 3,477,634 | 11/1969 | Kamins et al. | 383/15 |
| 3,509,927 | 5/1970 | Hasty et al. . | |
| 3,619,395 | 11/1971 | Skendzic . | |
| 4,000,768 | 1/1977 | Siegel . | |
| 4,630,311 | 12/1986 | Bentson . | |
| 4,658,975 | 4/1987 | Cone . | |
| 4,691,373 | 9/1987 | Ausnit . | |
| 4,846,585 | 7/1989 | Boeckmann . | |
| 4,911,562 | 3/1990 | Mazzeschi . | |
| 4,928,860 | 5/1990 | Knight . | |
| 4,966,470 | 10/1990 | Thompson . | |
| 5,022,530 | 6/1991 | Zieke . | |
| 5,033,868 | 7/1991 | Peppiatt . | |
| 5,035,517 | 7/1991 | Edelman . | |
| 5,059,033 | 10/1991 | Branson . | |
| 5,186,543 | 2/1993 | Cochran . | |
| 5,316,386 | 5/1994 | Moore | 383/63 X |

FOREIGN PATENT DOCUMENTS

| | | | |
|---|---|---|---|
| 813711 | 5/1969 | Canada | 383/15 |
| 0388364 | 9/1990 | European Pat. Off. . | |
| 1296741 | 5/1962 | France . | |
| 1476709 | 4/1967 | France | 383/63 |
| 0023955 | 1/1989 | Japan . | |
| 0098553 | 4/1990 | Japan . | |
| 404311457A | 11/1992 | Japan . | |
| 1008068 | 10/1965 | United Kingdom . | |

*Primary Examiner*—Jes F. Pascua
*Attorney, Agent, or Firm*—Crutsinger & Booth

[57] ABSTRACT

A resealable container including a body portion with front and rear panels on which interlocking closure strips are mounted to facilitate opening and resealing the container. A handle is formed by a pair of handle pieces, one of the handle pieces being secured to each of the resealable closure strips such that application of force to the handle pieces for lifting the container does not result in application of forces of sufficient magnitude for separating the closure strips which would result in opening the container. One or more handles are formed on the bottom of the container to facilitate pouring contents of the container.

11 Claims, 3 Drawing Sheets

HANDLE FOR RESEALABLE CONTAINER

CROSS REFERENCE TO RELATED APPLICATION

This application is a Continuation-in-Part of application Ser. No. 08/320,330, filed Oct. 11, 1994, entitled RESEALABLE CONTAINER WITH A SPLIT HANDLE, now abandoned.

TECHNICAL FIELD

A resealable container having a handle with two halves about a top opening of the container to relieve stress on resealable strips when it is carried and also having at least one handle on the bottom of the container for ease of pouring the contents of the container.

BACKGROUND OF INVENTION

Resealable plastic bags of the type that are commercially available under the registered trademark ZIPLOC of Dowbrands of Indianapolis, Ind., are used extensively for packaging small quantities of products for retaining moisture in the product or preventing entry of moisture into the bag. However, products of relatively large volume, for example, twenty to fifty pounds generally are not packaged in this type of container.

U.S. Pat. No. 3,402,749 to Kinzler and U.S. Pat. No. 5,033,868 Peppiatt disclose resealable plastic bags having hand hole openings positioned above pressure interlocking releasable rib and groove elements. These hand hole openings are lightweight and do not inherently have sufficient stiffness to support a heavily loaded bag. In fact, the bags tend to disfigure and bend about the hole opening area when the bags are loaded. Moreover, as these hole openings are made in the plastic tube, material is wasted as only a portion of the plastic tube is then available for filling.

This application relates to improvements in resealable bags of the general type disclosed in U.S. Pat. No. 4,000,786 entitled "PACKAGE HANDLES." This patent discloses a hang-up container made from thermoplastic synthetic material having a bag body attached to a separable fastener comprising extruded pressure-slide-or push-closure strips, one of which has a handle attached thereto. The package equipped with a package handle does not appear to be suitable for a relatively large volume of heavy material because it appears that undue stress would be exerted on the resealable strips if the bag were lifted by the handle attached to one of the strips. Further, the resealable strips do not appear to be mounted in a manner to prevent spilling fine granular material, such as soap or detergent, and does not appear to be mounted to form a waterproof closure.

A long felt need exists for a resealable impervious container provided with suitable handles to facilitate carrying a filled container and to facilitate pouring a portion of the contents from the container.

The bulk and weight associated with medium to large bags makes it difficult to effectively manage the emptying of the bag contents. To empty the right amount of animal food, fertilizer, grain, detergent or whatever the bag contents might be, requires a strong person with a strong grip. The problem is compounded when a person lacks the physical stature and strength to maneuver such bags. For example people who may not have the strength, or otherwise hesitate, to grasp and lift the outer surfaces of medium to large bags consist of elderly people, small children, people with repetitive strain injuries in their hands, wrists, or both, and people with cosmetic concerns such as long finger nails. For this relatively large class of people, frustration predominates when utilizing such bully containers.

At present, handles have been incorporated into containers to ease handling. U.S. Design Pat. No. 235,739 discloses a bag with handles. This device incorporates a one-piece handle mounted on one side of the bag at the top end and two handles attached to the outer edges of the bottom end of the bag. The bag is not disclosed as being resealable.

U.S. Pat. No. 4,911,562 and U.S. Design Pat. No. 304,546 disclose similar containers with handles for carrying fluid. U.S. Pat. No. 4,911,562 discloses a collapsible can with two handles adjacent to one another mounted to a sealed inclined upper edge of the can and another handle member defined in the corner of the can. The handles along the inclined upper edge are spaced at a predetermined distance from one another. The handles may be used to facilitate the pouring of liquid through a spout adjacent to the handles. Furthermore, a strap may be threaded through the handles for suspending the can on a user's shoulder. The corner handle member may be used to aid in tilting the can so that the liquid contents may be poured at a faster and accurate rate. U.S. Design Pat. No. 304,546 discloses a container with a handle member adjacent to a spout and a bottom seam designed to allow the container to stand on end, with apertures defined by the seam for apparently aiding the user in emptying the container.

Although these patents disclose containers with handle configurations, the designs have shortcomings that are overcome by the present invention. First, for containers with great weight, bulk or both, the one-piece handle disclosed in '739 might not be adequate. Under conditions where weight is a factor, such a design might have the tendency to shear the handle from the bag, causing the contents to spill and rendering the bag useless as a container. Furthermore, as a user carries the bag using both the handle on top, which is mounted to only one side, and the dual handle combination on the bottom, the bag might open without warning, causing the contents to yet again pour out, requiring time and labor to clean-up the spillage and to repack the bag.

Second, handles adjacent to the container opening, as disclosed in '546 and '562 restrict the size of the container opening. Although the structure adds to the container's structural strength and does not greatly affect the flow rate of a contained liquid, the opening's cross-sectional area is too small for an acceptable flow-rate of dry goods. Furthermore, these devices are structured to provide a well defined shape to aid in the pouring of liquid with little thought for dispensing dry goods.

SUMMARY OF INVENTION

The resealable container disclosed herein is a device to overcome the above mentioned drawbacks, by providing a top handle with two halves, or pieces, that add structural strength to prevent shearing of the handle from the container while carrying the loaded container and aids the user in pouring the contents in a controlled manner.

The top handle of the container is composed of two pieces, each piece similar to the other. Each handle piece is bonded to the top of the container on facing sides. This structure provides a large surface area connection to the container, preventing inadvertent ruptures of the container wall caused by shearing resulting from a weak bond to the container.

Another advantage is that with a two piece handle, when both sides are clasped, this action reinforces the closure strip located at the top of the container. Therefore, greater safety is instilled when manually transporting the container.

Another advantage is the capability to control dispensing of the container's contents. After opening the interlocking closure strip on the present invention, the user can grasp with one hand a handle piece and with the other hand the other handle formed at the base of the container. Once held by the handles, the user may then tilt the rear portion of the container via the rear handle, allowing the container's contents to flow out at a manageable rate. Without such devices, a user would have to rely on the strength of their grip to prevent dispensing too much of the container's contents.

DESCRIPTION OF DRAWINGS

Drawings of a preferred embodiment of the invention are annexed hereto so that the invention may be better and more fully understood, in which.

Other objects and advantages of the invention will become apparent upon reading the following detailed description and upon reference to the drawings, in which like reference characters are used throughout the drawings to designate like parts.

DESCRIPTION OF PREFERRED EMBODIMENT

Figure 1:
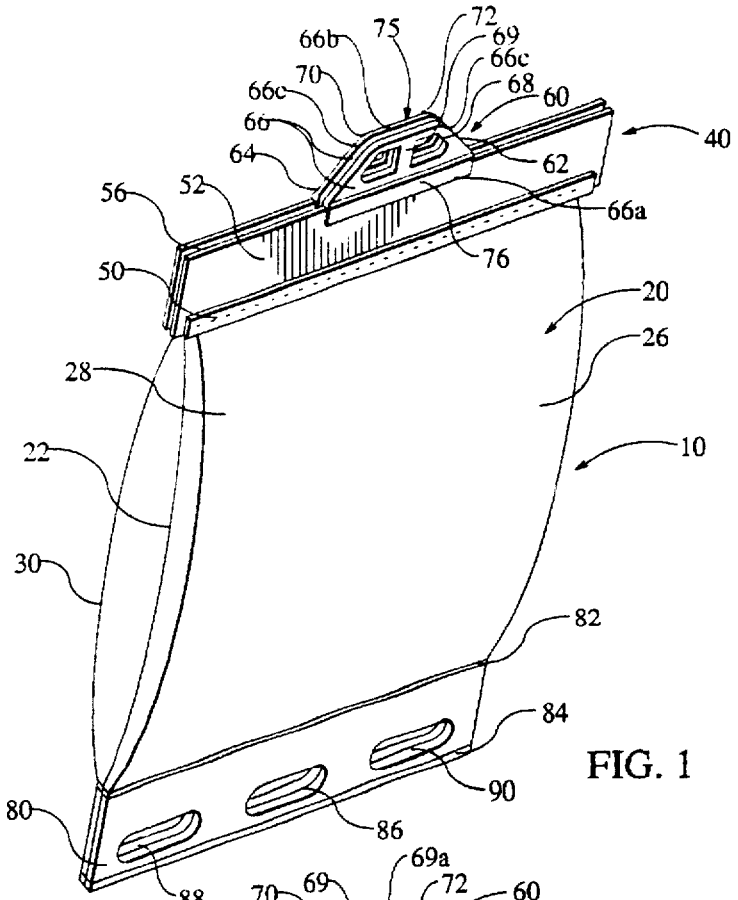
FIG. 1 is a perspective view of the resealable container with split handles.

In the embodiment illustrated in FIGS. 1–4, the resealable container 10 of the present invention has preferably a generally rectangular body portion 20, with front and rear panels 26 and 30, a resealable closure 40 formed by a pair of closure strips 42 and 44, a sewn pull tape 50 to facilitate opening the container, a handle 60, and an end flange 80, as illustrated in FIG. 1.

Figure 2:
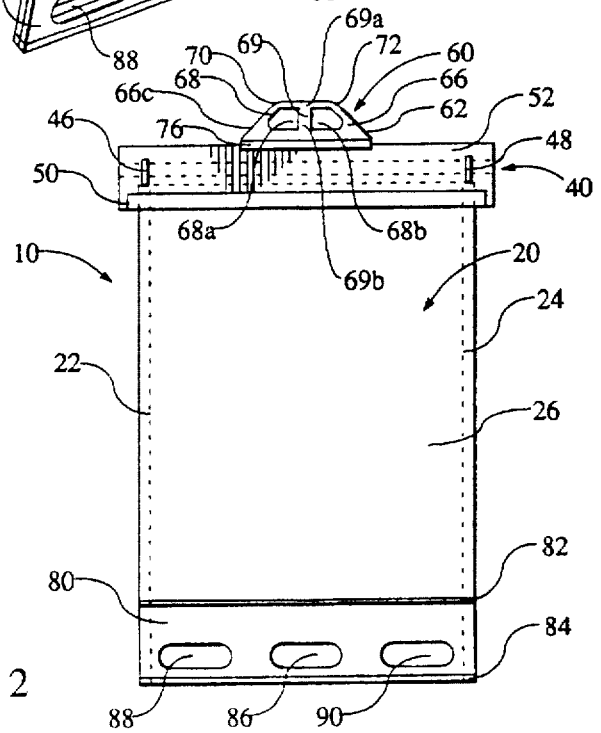
FIG. 2 is a front view of the resealable container with split handles.

Referring to FIG. 2, the rectangular body portion 20 is preferably formed by a generally rectangular sheet of two-ply plastic with an impervious inner layer and a pervious outer layer. The plastic sheet is folded lengthwise upon itself and heat sealed along the edges along the length of the rectangular piece, forming a tube. The tubular form is creased so that gussets 22 and 24 are formed on opposite sides of the tube, inset preferably about 1.5 inches. Gussets 22 and 24 are collapsible so that rectangular body portion 20 is generally flat when it is empty. Body portion 20 comprises a front panel 26 having an interior surface 27 and an exterior surface 28 and a rear panel 30 having an interior surface 31 and an exterior surface 32. With gussets 22 and 24 in place, the planar body portion 20 can be expanded into a tube with a generally rectangular cross-section. Other methods of creating the tubular form include extruding a seamless cylinder or placing two equal sized generally rectangular sheets of plastic upon each other and heat sealing along the lengths of the rectangles forming two seams.

If container 10 is to be used for packaging materials which require a substantially air-tight seal to prevent entry of moisture or insects, gussets 22 and 24 may be eliminated because minute openings are sometimes left adjacent upper and lower ends of the gussets when attempting to seal the upper and lower ends of the bag adjacent extremities of the gussets.

Figure 3:
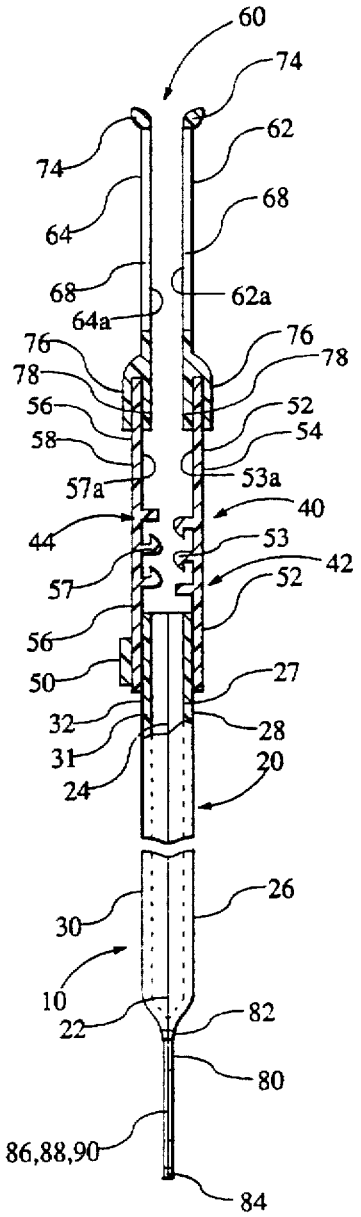
FIG. 3 is a side view of the resealable container, parts being broken away to more clearly illustrate details of construction.
Figure 4:
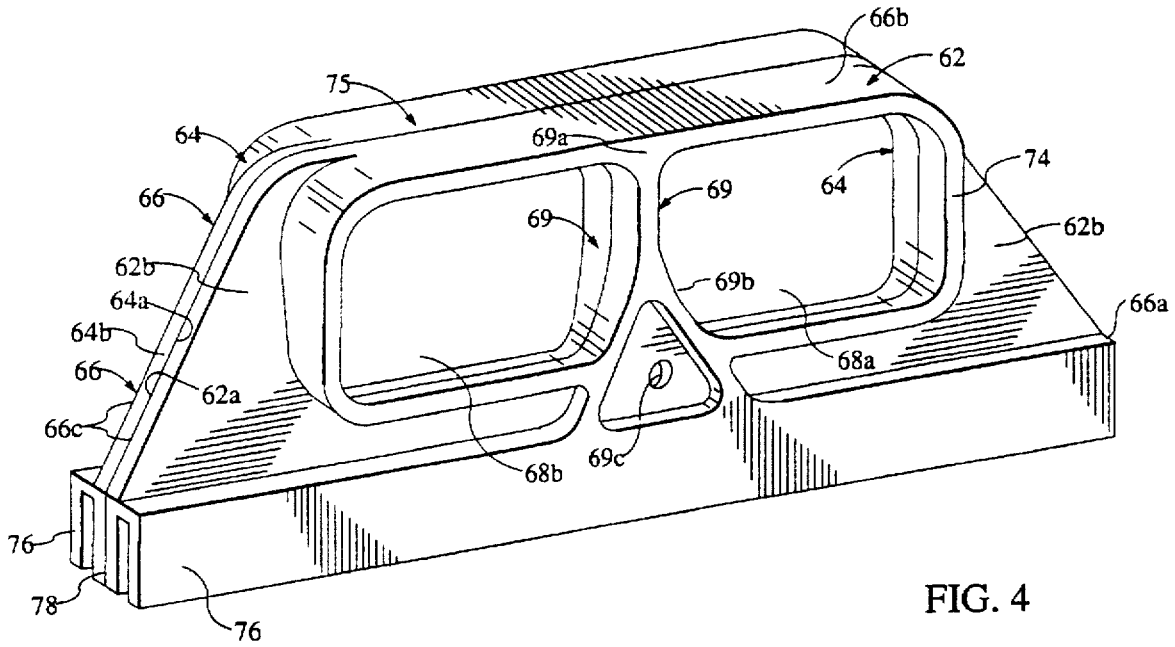
FIG. 4 is an enlarged perspective view of the handle.
Figure 5:
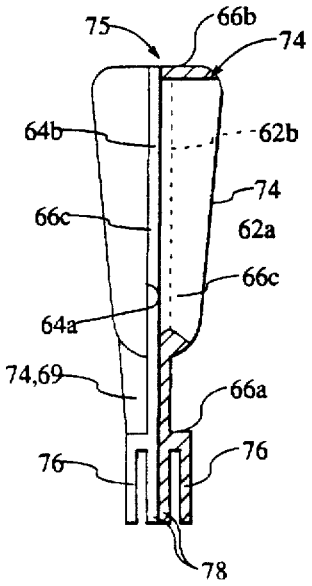
FIG. 5 is a side partial cross-sectional view of the handle of the first embodiment.

Referring to FIG. 3, the interlocking closure strip 40 is comprised of a fastener strip 42 and a complementary fastener strip 44, for example of the type disclosed in U.S. Pat. No. 4,000,768 to Edelman, the disclosure of which is incorporated herein by reference for all purposes. Fastener strip 42 comprises an attachment flange 52 with interlocking ribs 53 formed on an interior surface 53*a* that extend along the length of the attachment flange 52. Closure strip 44 similarly comprises an attachment flange 56 with complementary interlocking ribs 57 formed on its interior surface 57*a* that extend along the length of attachment flange 56. It should be noted that both attachment flanges extend beyond the edges of body portion 20 to ensure a complete seal of the top of body 20. Attachment flanges 52 and 56 are heat sealed or bonded with adhesive to outer surfaces 28 and 32 of container 10 and are also provided with a tear strip 50 to main the seal during transportation and handling.

Closure strip's interlocking ribs 53 and 57 are preferably positioned above the top edge of rectangular body portion 20 and, as previously described, extend beyond the sides of body 20 to assure a complete seal for container 10. As these containers can be used to hold various food products, it is important to provide an effective seal to keep out moisture, and in some cases, oxygen. Interlocking closure fastener strips 42 and 44 are sealed by welds 46 and 48 that are formed by heat sealing the interlocking closure strips at points aligned with the edges of the rectangular body portion 20 of container 10. The welds 46 and 48 are positioned to close the space between front and rear panels 26 and 30, gussets 22 and 24, and strips 42 and 44.

Referring to FIG. 2, the pull tape 50 is sewn onto the bottom edge of front attachment flange 52 of interlocking strip 42 and rear attachment flange 56 of interlocking strip 44, thereby sealing the top of the front panel 26, rear panel 30, gusset 22, and gusset 24 of rectangular body portion 20. The pull tape 50 is of the type commercially available under the registered trademark RIP-N-ZIP from KCL Corporation of Shelbyville, Ind., similar to that disclosed in U.S. Pat. No. 5,035,517, that issued Jul. 30, 1991 to Paul F. Edelman. Strips 42 and 44 that form interlocking closure strip 40 and easy-open-pull tape 50 are commercially available as a combined unit as a RIP-N-ZIP®.

Handle 60 comprises a split handle having a first handle piece 62 and a second handle piece 64. Each handle piece 62 and 64 is formed from a rigid light weight material, such as plastic, and comprises a trapezoidal-shaped member 66 having a wide base portion 66*a*, to distribute the weight across a wide portion of the top of the bag, and a narrower top portion 66*b* with sloping sides 66*c* extending therebetween. Sides 66*c* are generally planar flange members 62*b* and 64*b* that extend from the top portion to the base and provide stiffness to the handle in the plane defined by the trapezoidal-shaped member 66 and, as a result, increase the carrying capacity of the handle 60. A preferred base 66*a* length of the trapezoidal-shaped member 66 is in the range between about five to nine inches. A preferred height of the trapezoidal shape 66 is in the range between about one and one-half to three inches.

Figure 6:
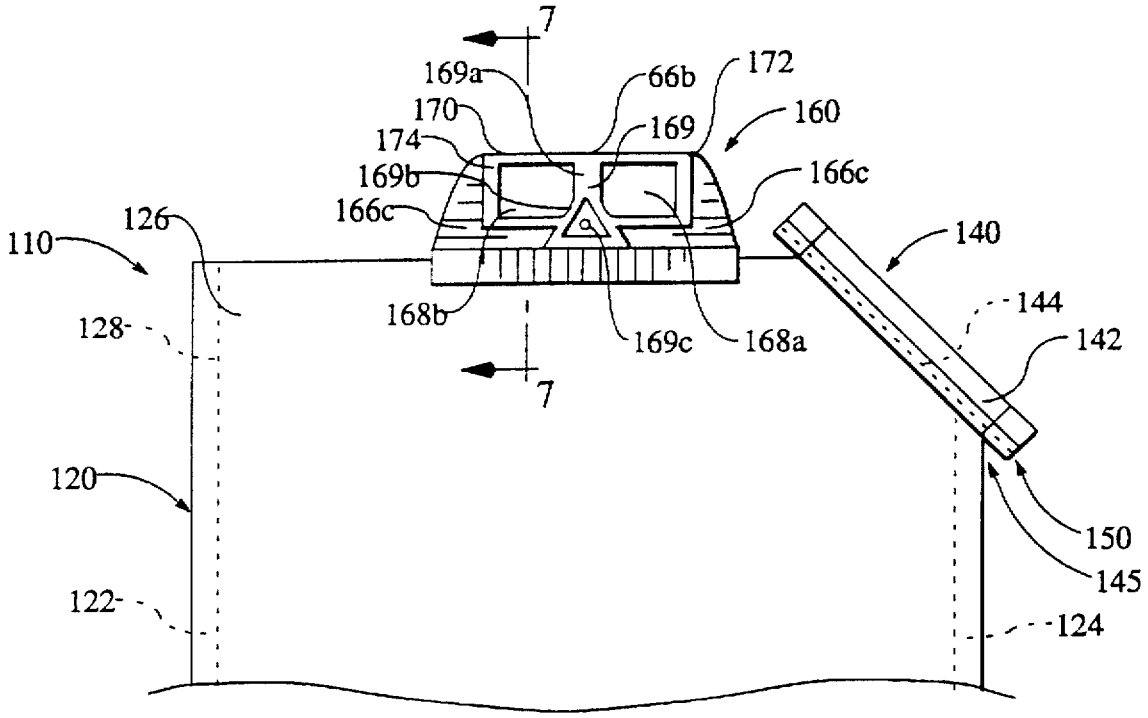
FIG. 6 is a perspective view of a second embodiment of the resealable container with a resealable corner.

As can be seen in FIG. 6, handle pieces 62 and 64 have generally triangular side profiles with planar interfacing surfaces 62*a* and 64*a* that are in an abutting relationship with each other when container 20 is closed, thereby directing the weight of the bag through a generally straight path from the edges of the bag to the bag handle 60, as will be more fully described below.

Referring to FIGS. 2 and 3, the trapezoidal-shaped member 66 includes a central oblong opening 68 to accommodate a person's hand. Oblong opening 68 includes rounded top corners 70 and 72 which provide a smooth holding surface thus making it easier to hold the bag from several angles. The oblong opening 68 is preferably divided by a centrally disposed rigid member 69 which stiffens handle 60 and forms two smaller oblong openings 68*a* and 68*b*. Rigid member 69 includes a top portion 69*a* that connects to the upper edge of opening 68 and a triangular-shaped base 69*b* that connects to the lower edge of opening 68. The triangular shaped base 69*b* increases the stiffening characteristics of the rigid member 69 and includes a centrally disposed aperture 69*c* to accommodate a strap or straps. Straps (not shown) may be used to suspend the bag for storage.

Referring to FIG. 3, a ridge 74 is formed by a reinforcing rib which encircles the oblong opening 68. The reinforcing rib is generally orthogonal to interfaces 62*a* and 64*a* and extends along the upper edge of the oblong aperture 68 with a first depth and tapers down to a smaller depth along the bottom edge of the aperture 68. Thus, from an elevational view perspective, the handle pieces 62 and 64 each have a triangular profile. In the preferred embodiment reinforcing rib 74 also extends down the central rigid member 69, thereby further stiffening handle 60, and the triangular base of rigid member 69*b* so that a filled bag can be suspended through aperture 69*c* from a strap, nail or peg, without causing local tearing of the handle.

Extending from the base 66*a* of trapezoidal-shape member 66 is a first flange 76 and second flange 78 of equal size and generally rectangular shape. A preferred width of the first flange 76 and the second flange 78 is in the range between about one-half to one inch. The top edge of the front attachment flange 52 of fastening strip 42 is inserted between the first flange 76 and second flange 78 of the first handle piece 64. The first handle piece 62 is centered on the front attachment flange 52 with the ridge 74 facing outward. The flanges 76 and 78 are then heat sealed by ultrasonic welding to the front attachment flange 52 of fastening strip 42. The top edge of the rear attachment flange 56 of fastening strip 44 is similarly inserted between the first flange 76 and second flange 78 of the second handle piece 64. The second handle piece 64 is centered on the rear attachment flange 56 with the ridge 74 facing outward. The flanges 76 and 78 are then heat sealed to the rear attachment flange 56.

It can be appreciated that the ridge 74 of first handle piece 62 and the ridge 74 of the second handle piece 64 together provide wide gripping member 75 and, consequently, distribute the weight of the bag over a greater surface area of the hand, thus reducing local stresses in the hand. Furthermore, as the gripping member 75 has an appreciable width, a person's grip on the handle will tend to force the two handle pieces 62 and 64 together in an abutting relationship as the ridges will span the cradle of an average person's hand. When a split handle's halves are too narrow, a hand cannot grip the handle tight enough to force the handle halves in an abutting relationship without creating undue strain on the hand.

Moreover, when the two interfacing surfaces 62*a* and 64*a* of handle pieces 62 and 64 abut each other, the two flanges 78 are also in an abutting relationship. Consequently when the bag is filled, the gravitational forces that act on the bag's mass will be directed through the handle in a generally straight path from attachment flanges 52 and 56 to the handle's flanges 76 and 78 and, then, to the gripping member 75. Furthermore, as there are essentially no gaps between the two handle pieces, only small or insignificant moments will be created by the reaction force applied by the hand; instead, the reaction forces will be generally tensile forces centered through the front and rear attachment flanges 52 and 56 and will, therefore, not induce attachment flanges 52 and 56 to separate and unlock the interlocking ribs 53 and 57.

Referring to FIG. 2, the generally rectangular end flange 80, comprises a flange seam 82 located at least three inches from the end seam 84. The resealable container 10 must be filled with its contents before the flange seam 82 is created. Both seams 82 and 84 are formed by heat sealing. At least one oblong aperture 86 is centrally located in the end flange 80. A preferred size of the aperture 86 is between about four and six inches long and between about one and one and one-half inches wide. Similar apertures 88 and 89 or circular holes are formed near the edges of the end flange 80. The terms "top, bottom, end, front and rear" refer to the illustrated embodiment. The use of these terms is not intended to be limiting and it should be readily apparent that the terms are used to facilitate description of the structure and are not intended to be limiting in nature. If container 10 were rotated 120°, handles on the "bottom" of the container would be at the upper end thereof.

From the foregoing it should be readily apparent that the resealable bag or container 10 has a body portion 20 with front and rear panels having top, bottom and side edges. One of the fastener strips is secured to the top of the front panel of the body portion of the container and a second of the closure strips is secured to the top of the rear panel of the body portion of the closure. The closure strip extend past the top edge and side edges of the body portion of the container to ensure an air tight seal of the container.

First and second handle pieces 62 and 64 are secured to upper edges of each of the attachment flanges 52 and 56 by flanges 76 and 78. As the handle pieces 62 and 64 are configured to direct the lifting force in a generally straight path, the application of force to the handle pieces does not result in application of force that would separate the first and second interlocking closure strips. Thus, lifting the container by the handle from its upper end does not tend to separate the attachment flanges and, thereby, open the container.

It should be readily apparent that provision of two flanges 76 and 78 extending from the base of each handle piece provides increased bonding surfaces covering a significant area of upper portions of the front and rear panels. A strong bond is formed between the handles and the body 20 of container 10 that is capable of withstanding forces required for carrying a container filled with a large volume of heavy material.

The provision of one of more handles adjacent the bottom of the container facilitates pouring contents from the container. For example, if container 10 is filled with dog food, a portion of the closure strips adjacent one corner of the container may be separated between the handle on the top of the container and the corner of the container. The bottom of the container can be gripped by positioning fingers through opening 88 for lifting and tilting the container while the handle at the top of the container is gripped with the other hand. After a predetermined volume of the contents has been removed, the unlocked portion of the interlocking closure strips are pressed together for resealing the container.

Figure 7:
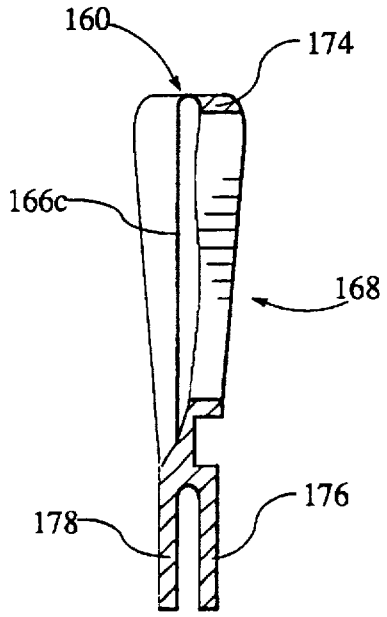
FIG. 7 is a cross-sectional view of the handle of the second embodiment taken along line 7—7 in FIG. 6.

In a second preferred embodiment, illustrated in FIGS. 6 and 7, container 110 similarly comprises a generally rectangular body portion 120, with front and rear panels 126 and 130 and optional reinforcing ribs 122 and 124, and a resealable closure 140 formed by a pair of closure strips 142 and 144. Only the top portion of container 110 is illustrated as the lower portion of the container is of similar construction to the lower portion of container 10 in the previous embodiment.

Container 110 is preferably heat sealed on all four sides, with one upper corner 145 left unsealed to provide a mouth to direct the dispensing of material from the container. Corner 145 is preferably formed or cut at an angle of approximately 45 degrees to provide a diagonal edge; however, it should be understood that this angle may vary considerably depending on the type material that is being stored in container 10. For instance for fine material, an angle in the range of 45 degrees to 20 degrees, as measured counterclockwise from the vertical edge of container 110 in FIG. 6, may provide more control of the dispensing of the material.

Closure strips 142 and 144 are provided at the unsealed corner 145 of the rectangular body to seal the bag when the material is not being dispensed. Closure strips 142 and 144 are of similar construction and are attached to the bag in a similar manner as the closure strips 42 and 44 in the previous embodiment. Furthermore, closure strips 142 and 146 are provided with a tear strip 150 so that the container will remain sealed during transportation and handling.

Handle 160 comprises a single handle formed from a rigid light weight material, such as plastic, and comprises a trapezoidal-shaped member 166 having front and rear surfaces 162 and 164, a wide base portion **166*a*, narrower top portion 166*b*, and sloping sides 166*c* extending therebetween. Sides 166*c* are generally planar flange members 162*b* and 164*b* which provide stiffness to the handle and, as a result, increase the carrying capacity of the handle 160. A preferred base 166*a* length of the trapezoidal shape 166 is in the range between about five to nine inches. A preferred height of the trapezoidal shape 166** is in the range between about one and one-half to three inches.

As can be seen in FIG. 7, handle 160 has a generally inverted triangular shaped side profile with a gripping member 175 formed at the top end **166*b* of the handle and downwardly depending flanges 176 and 178 extending from the base end 166*a*. The handle 160 includes a central opening 168 with rounded top corners 170 and 172 to accommodate a person's hand. Opening 168 is preferably divided into two smaller openings 168*a* and 168*b* by a centrally disposed rigid member 169. Rigid member 169 extends between and connects to the upper and lower edge of opening 68. Consequently, rigid member 169 provides support for gripping member 175 and stiffens the entire handle 160. Rigid member 169 includes a top portion 169*a* that connects to the upper edge of opening 168 and a triangular-shaped base 169*b* that connects to the lower edge of opening 168. The triangular shaped base 169*b* further increases the stiffening characteristics of the rigid member 169 and includes a centrally disposed aperture 169*c* to accommodate a strap, nail or peg for suspending the container. Additional apertures may be provided in flange members 162*b* and 164*b***.

Referring to FIGS. 6 and 7, two ridges **174*a* and 174*b* are provided on front and rear surfaces 162 and 164 and are formed by reinforcing ribs which encircle the opening 168. The reinforcing ribs are generally orthogonal to flange members 162*b* and 164*b* and extend along the upper edge of the oblong aperture 168 with a first depth and taper down to a smaller depth along the bottom edge of the aperture 168. Ridges 174*a* and 174*b* form gripping member 175 and provide the triangular profile for handle 160. Moreover, these ridges provide increased stiffness to handle 160 and, in so doing, distribute the forces over a large portion of the handle. The ridges provide increased protection to the hand in that they distribute the lifting forces over a greater area of the handle. Furthermore, the horizontal extent of the gripping member 175** increases the amount of control a person lifting the bag can exert.

In the preferred embodiment reinforcing rib 174 also extends down the central rigid member 169, thereby further stiffening handle 160 and the triangular base of rigid member **169*b* so that the container 120** can suspended from a strap without causing local tearing of the handle.

Handle 160 attaches to the attachment flanges 152 and 156 of closure strip 140 in a similar manner to the previous embodiment. Flanges 176 and 178 are heat sealed by ultrasonic welding or bonded by adhesive to the front and rear surfaces of body 120.

It should be appreciated that other and further embodiments of the invention may be devised without departing from the basic concept thereof.

What I claim is:

1. A resealable container comprising:

a tube forming a container body having a front panel and a rear panel, said front and rear panels having top and bottom edges and side edges;

a pair of interlocking resealable closure strips for providing an air-tight seal, one of said closure strips being bonded to the top of the front panel of said body and a second of said closure strips being bonded to the top of said rear panel of said body, said closure strips having end portions extending past the top edge and side edges of said body;

first and second handle pieces having at least one hand receiving aperture in each handle piece, each of said handle pieces having at least two flanges, said flanges on said first handle piece being secured to a first of said closure strips and said flanges on said second handle piece being secured to a second of said closure strips, said handle pieces being rigid and positioned such that application of force to said handle pieces for lifting said container body does not result in application of forces of sufficient magnitude for separating said first and second resealable closure strips.

2. A resealable container as recited in claim 1, said front and rear panels on said container being secured together adjacent said bottom edges to form a chamber having an upper end bounded by said closure strips and a bottom end.

3. A resealable container as recited in claim 2, with the addition of handle means adjacent said bottom edges of said front and rear panels on said container.

4. A resealable container as recited in claim 1, said front and rear panels on said container having impervious inner surfaces to prevent migration of moisture through said panels and an ink receptive outer surface.

5. A resealable container as recited in claim 1, wherein said handle pieces each have inwardly facing, abutting surfaces.

6. A resealable container as recited in claim 5, wherein said inwardly facing abutting surfaces have planar portions.

7. A resealable container as recited in claim 1, wherein each of said handle pieces includes a ridge extending along a top portion of said handle and around said hand receiving aperture, thereby forming a hand grip portion at said top portion of each of said handle pieces and providing stiffness to each of said handle pieces, said hand grip portions aligning to form a single hand grip when said handle is held.

8. A resealable container as recited in claim 7, wherein said handle pieces include interfacing surfaces having planar portions, said planar portions extending from said top portion of each of said handle pieces to a base portion of said handle pieces and abutting each other when said container is sealed thereby reducing the bending stresses in the handle which tend to separate the closure strips.

9. A resealable container comprising:

a container body having flexible front and rear panels, said front and rear panels having top and bottom edges and side edges;

a pair of interlocking resealable closure strips for providing an air-tight seal, one of said closure strips being bonded to the top of said flexible front panel of said body and a second of said closure strips being bonded to the top of said flexible rear panel of said body;

first and second handle pieces, each of said first of second handle pieces having a central body with top and base portions, said base portions including downwardly depending spaced apart flanges straddling the top edge of said container body and being secured thereto, an opening formed in said central body of said first and second handle pieces, and reinforcing ribs extending along said top portions and around said opening thereby forming a hand grip portion at said top portion of said handle and providing stiffness to said handle such that application of force to said handle pieces for lifting said container body does not result in application of forces of sufficient magnitude for separating said first and second resealable closure strips.

10. A resealable container according to claim 9, wherein said handle further includes a rigid member dividing said opening into two smaller openings, said rigid member extending from an upper edge of said opening adjacent said top portion of said handle to a lower edge of said opening.

11. A resealable container according to claim 10, wherein a reinforcing rib extends along said rigid member.

* * * * *